United States Patent [19]

Marulic

[11] Patent Number: 4,888,920

[45] Date of Patent: Dec. 26, 1989

[54] GUTTER ANTI-CLOGGING DEVICE

[76] Inventor: Walter J. Marulic, Box 164C, Cumming, Ga. 30130

[21] Appl. No.: 235,479

[22] Filed: Aug. 24, 1988

[51] Int. Cl.[4] ..... F04D 13/06

[52] U.S. Cl. ..... 52/12; 52/11

[58] Field of Search ..... 52/12, 11

[56] References Cited

U.S. PATENT DOCUMENTS

| | | | |
|---|---|---|---|
| 2,175,138 | 10/1939 | Westlake, Jr. | 52/12 |
| 2,175,521 | 10/1939 | Fry | 52/12 |
| 2,219,953 | 10/1940 | Fry | 52/12 |
| 2,526,271 | 10/1950 | Probst | 52/12 |
| 2,734,467 | 2/1956 | Steele | 108/30 |
| 2,841,100 | 7/1958 | Moller | 52/12 |
| 3,067,881 | 12/1962 | Goosmann | 52/12 |
| 3,351,206 | 11/1967 | Wennerstrom | 210/474 |
| 3,834,091 | 9/1974 | Dugan | 52/12 |
| 4,553,356 | 11/1985 | Pepper | 52/11 |
| 4,592,174 | 6/1986 | Hileman | 52/12 |
| 4,604,837 | 8/1986 | Beam | 52/12 |
| 4,607,465 | 8/1986 | Hopkins | 52/12 |
| 4,616,450 | 10/1986 | Shouse | 52/12 |

FOREIGN PATENT DOCUMENTS

| | | | |
|---|---|---|---|
| 734648 | 5/1966 | Canada | 52/12 |

*Primary Examiner*—Michael Safavi

*Attorney, Agent, or Firm*—Myers & Ehrlich, Ltd.

[57] ABSTRACT

The invention is of a gutter anti-clogging device for preventing a gutter affixed to a facia of a building from being clogged with debris. The gutter is mounted beneath an overhang of a roof and has a basically U-shaped cross section. An inner gutter leg extends upwardly, and longitudinally along, the facia. A gutter base extends generally horizontally outward from, and longitudinally along, the inboard gutter leg. An outer gutter leg extends upwardly from, and longitudinally along, the gutter. The gutter anti-clogging device includes mesh and retaining clips. The mesh, defines mesh orifices surrounded by longitudinal wire and transverse wire, and extends longitudinal along the gutter. The mesh has a L-shaped cross section with an integral inner mesh leg and an integral sloped mesh leg. The inner mesh leg is disposed adjacent the inner gutter leg and extends above an uppermost end of theouter gutter leg. The integral sloped mesh leg extending downwardly and outwardly from an upper end of the inner mesh leg to an upper end of the outer gutter leg. The retaining clips have a generally U-shaped cross section with an inner clip leg, a clip base and an outer clip leg. The inner clip leg is inserted downward through a mesh orifice. The clip base extends outward of the inner clip leg, and the outer clip leg extends downward from the clip base and the upper end of the outer gutter leg to frictionally secure the clip and mesh to the gutter.

1 Claim, 1 Drawing Sheet

GUTTER ANTI-CLOGGING DEVICE

BACKGROUND OF THE INVENTION

This invention relates to the field of Gutter Anti-Clogging Devices and particularly relates to screens affixed to gutters to prevent debris from impeding the desired drainage of water.

Various gutter anti-clogging devices are known in the art and some are described in issued patents.

U.S. Pat. No. 2,734,467 to Steele describes a GUTTER SCREEN having a generally planar mesh bounded by U-shaped reinforcing means at inner and outer ends. The inner end of screen rests on the end of a sloped roof and the outer end is resiliently secured to the outer articulated wall of the gutter by flat split brackets which apparently bias the inner edge of the mesh against the roof.

U.S. Pat. No. 2,841,100 to Moller describes a MOVABLE SCREEN FOR EAVES TROUGHS having a generally planar mesh bounded at its outer end by a reinforcing rod and having an inner end resting on the end of a sloped roof. The reinforcing rod is pivotally secured to an outer edge of a gutter by U-shaped brackets and the mesh may be pivoted outward by downward force on arms projecting outwardly of the gutter. Alternately, a combined spring and bracket fixedly secures the reinforcing rod to the outer edge of the gutter.

U.S. Pat. No. 3,351,206 to Wennerstrom describes a STRUCTURE FOR SECURING GUTTER SCREENING TO BUILDING GUTTERS. A flat mesh is disposed horizontally or tilted inwardly toward the roof. The inner edge of the mesh rests on the roof and the outer edge is secured to an outer edge of a gutter by a structure extending along the outer longitudinal edge of the mesh which grasps the mesh between an upper and middle arm and an inner directed horizontal flange of the gutter between the middle and lower arm.

U.S. Pat. No. 3,834,091 to Dugan describes a HINGED GUTTER COVER including a plurality of planar mesh sections each peripherally surrounded by a rigid rod frame. The outer rod is pivotally secured to the outer edge of the gutter and the inner rod rests on the end of a sloped roof. A dumping handle extends outwardly of the gutter to allow a mesh section to be pivoted outward.

U.S. Pat. No. 4,553,356 to Pepper describes a RAINWATER GUTTER SEALING ARRANGEMENT. The arrangement includes an arcuate perforated joining strip, bowed upwardly, exerting force against a sealing strip adjacent a facia by being placed in compression by the outer edge of a gutter.

U.S. Pat. No. 4,533,357 to Pepper describes an ADJUSTABLE RAINWATER GUTTER MOUNTING ARRANGEMENT. The mounting arrangement of this patent allows the base of the gutter shown in the Pepper '356 patent to be adjusted to slope slightly outward.

U.S. Pat. No. 4,616,450 to Shouse describes an EAVES TROUGH/RAIN GUTTER SHIELD having a solid upper surface and a depending outward flange containing rain guidance apertures and rain receiving apertures.

SUMMARY OF THE INVENTION

The invention is of a gutter anti-clogging device for preventing a gutter, affixed to a facia of a building from being clogged with debris.

The gutter is mounted beneath an overhang of a roof and has a basically U-shaped cross section. An inner gutter leg extends upwardly, and longitudinally along, the facia. A gutter base extends generally horizontally outward from, and longitudinally along, the inboard gutter leg. An outer gutter leg extends upwardly from, and longitudinally along, the gutter.

The gutter anti-clogging device includes mesh and retaining clips.

The mesh, defines mesh orifices surrounded by longitudinal wire and transverse wire, and extends longitudinally along the gutter. The mesh has an L-shaped cross section with an integral inner mesh leg and an integral sloped mesh leg. The inner mesh leg is disposed adjacent the inner gutter leg and extends above an uppermost end of the outer gutter leg. The integral sloped mesh leg extending downwardly and outwardly from an upper end of the inner mesh leg to an upper end of the outer gutter leg.

The retaining clips have a generally inverted U-shaped section with an inner clip leg, a clip base and an outer clip leg. The inner clip leg is inserted downward through a mesh orifice. The clip base extends outward of the inner clip leg, and the outer clip leg extends downward from the clip base and the upper end of the outer gutter leg to fictionally secure the clip and mesh to the gutter.

DETAILED DESCRIPTION OF THE DRAWING

Figure 1:
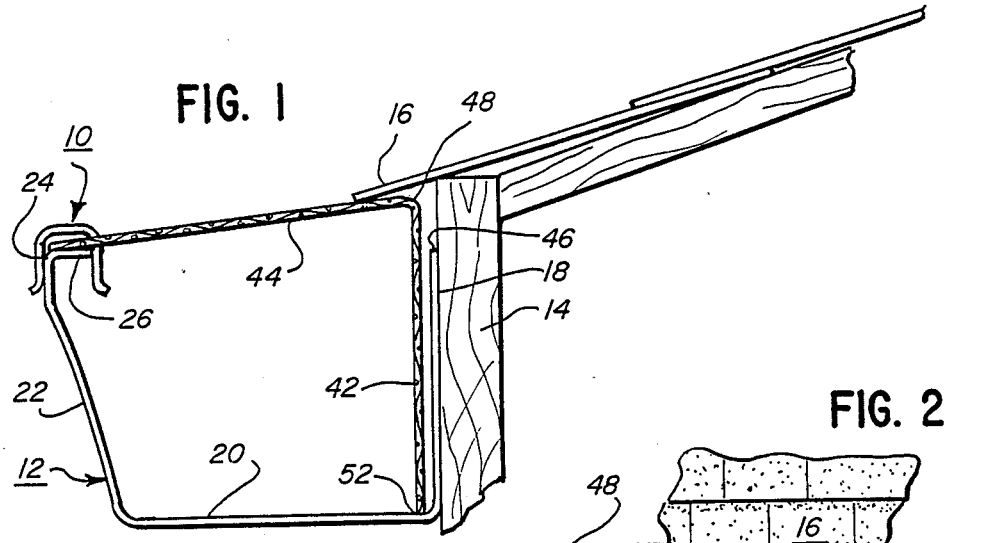
FIG. 1 of the drawing is a cross-section of the gutter anti-clogging device of the present invention in its intended environment.
Figure 2:
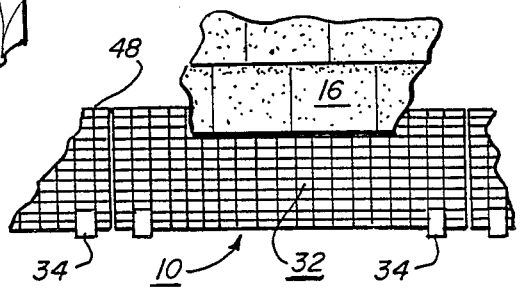
FIG. 2 of the drawing is a fragmentary perspective of the gutter anti-clogging device of the present invention in its intended environment.
Figure 3:
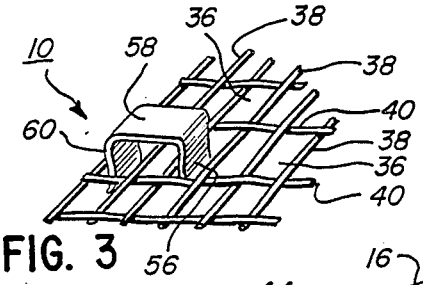
FIG. 3 of the drawing is a fragmentary perspective of the gutter anti-clogging device of the present invention.

FIG. 1 is a cross-section of the gutter anti-clogging device 10 of the present invention in its intended environment secured to a gutter 12 affixed to the facia 14 of a building beneath an overhanging roof 16.

Gutter 12 has a basically U-shaped cross section. An inner gutter leg 18 extends upwardly, and longitudinally along, the facia 14. A gutter base 20 extends generally horizontally outward from, and longitudinally along, the inboard gutter leg 18. An outer gutter leg 22 extends upwardly from, and longitudinally along, the gutter base 20. At the upper end 24 of the outer gutter leg 22, there is an inward directed gutter flange 26. Spikes 28 at preselected longitudinal intervals are typically driven through the outer and inner gutter legs 18, 22 and into facia 14 to secure gutter 12 to facia 14. Often as illustrated, the portion of the spikes 28 between inner gutter leg 18 and outer gutter leg 22 is surrounded by cylindrical tube 30 which can be considered as a part of spike 28 herein.

The gutter anti-clogging device 10 includes mesh 32 and retaining clips 34.

Figure 4:
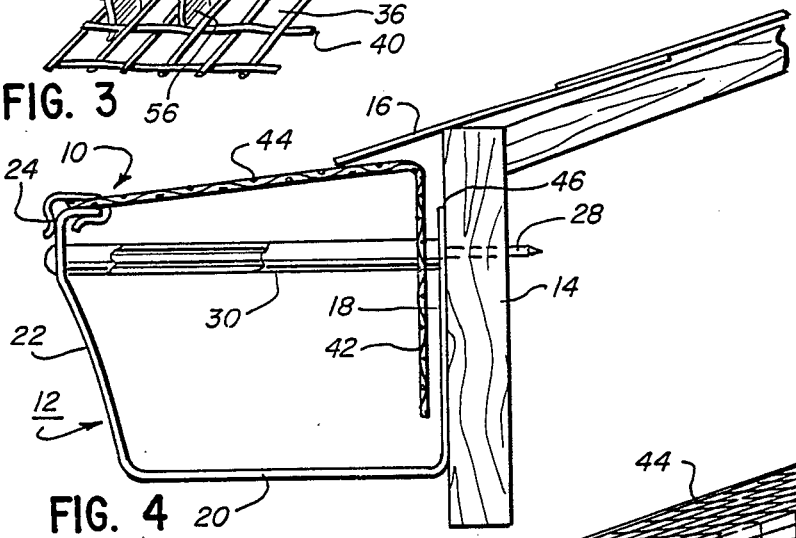
FIG. 4 of the drawing is a cross-section of another embodiment of the gutter anti-clogging device of the present invention in its intended environment.
Figure 5:
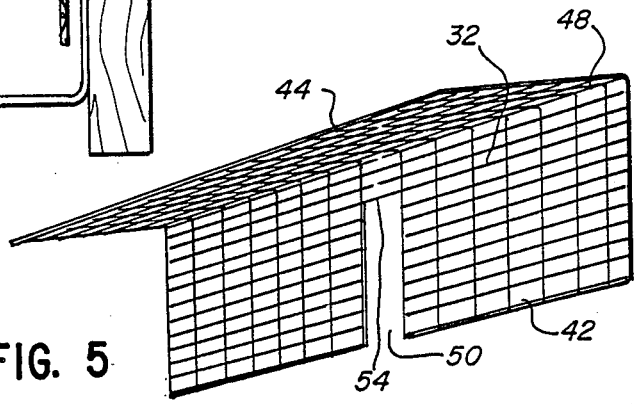
FIG. 5 of the drawing is a perspective of a mesh element of the gutter anti-clogging device of the present invention.

Mesh 32, defines mesh orifices 36 surrounded by longitudinal wire 38 and transverse wire 40, and extends longitudinal along the gutter. The mesh has an acute angled L-shaped cross section with an integral inner mesh leg 42 and an integral sloped mesh leg 44. The inner mesh leg 42 is disposed adjacent the inner gutter leg 18 and extends above an uppermost end 46 of the inner gutter leg. The integral sloped mesh leg 44 extends downwardly and outwardly from the upper end 48 of the inner mesh leg 42 to the upper end 24 of the outer gutter leg 22. Normally, for residential use where economy dominates, carbon steel mesh in flat sheets is bent at upper end 48 to create mesh 32 of the proper dimensions. Although mesh of a variety of dimensions may be employed, wire of approximately 0.03125 inch (0.08 cm.) diameter defining orifices of approximately 0.25 inch (0.64 cm.) by 0.60 inch (1.5 cm.) is preferred. For installations which are awkward to replace, galvanized steel, stainless steel, bronze, or other corrosion resistant materials, such as plastic coated steel, may be employed. In most installations where spikes 28 fasten gutter 12 to facia 14, it is desirable to remove portions of the longitudinal wires 38 to create slots 50 in inner mesh leg 42 to allow the inner mesh leg 42 to extend below spikes 28 as shown in FIG. 4. In most cases it is advantageous to have the lower end 52 of inner mesh leg 42 rest on gutter base 20 as shown in FIG. 1. However, where spikes 28 are employed the inner leg may be supported by spikes 28 at the upper end 54 of a slot 50 as shown in FIG. 4.

The retaining clips 34 have a generally U-shaped cross section with a inner clip leg 56, a clip base 58, and an outer clip leg 60. The inner clip leg 56 is inserted downward through a mesh orifice 36. The clip base 58 extends outward of the inner clip leg 56, and the outer clip leg 60 extends downward from the clip base 58 and the upper end 24 of the outer gutter leg 22 to fictionally secure the clip 34 and mesh 32 to the gutter 12. The clip 34 should have resilient legs 56, 60 and is preferably fabricated from plastic or spring steel. Corrosion resistant materials are desirable when corrosion resistant mesh is employed. Where gutter inner flange 26 is present, it is desirable to form clip inner leg 56 so that it extends outward and under inner flange 26, as shown in FIG. 4.

It will be observed that the upper portion 44 of the screen is inclined downwardly toward its outer edge to facilitate any debris cascading off the roof to readily roll off the screen. Furthermore, if necessary, if the screen becomes clogged and requires removal, the fasteners 24 may be easily unsnapped and the screen withdrawn from under the roofing paper 16 and then rotated about its outer edge to withdraw portion 42, or the screen may be withdrawn sidewise. The depth of portion 42 will prevent any debris which has hung up on the edge of paper 16 from falling into the gutter as portion 42 is withdrawn from under the roofing. Also the angular relations of portions 42, 44 forms a corner at 48, thus rigidifying the screen strip lengthwise thereof.

I claim:

1. An easily removable and replaceable gutter anti-clogging device for presenting a gutter affixed to a facia of a building from being clogged with debris, the gutter being mounted beneath an overhang of a roof and having a basically U-shaped cross section with an inner gutter leg extending upwardly and longitudinally along the facia, a gutter base extending generally horizontally outwardly from and longitudinally along, the inner gutter leg, and an outer gutter leg extending upward from, and longitudinally along, the gutter base, and having an upper inturned portion, said gutter anti-clogging device comprising:

a screen mesh, defining mesh orifices surrounded by longitudinal wire and transverse wire, extending longitudinally along the gutter and having an acute angled L-shaped cross section defining an integral flat inner mesh leg loosely disposed along side the inner gutter leg unconnected thereto and extending above an uppermost end of the inner gutter leg to beneath the overhang, and having an integral flat upper mesh leg sloping downwardly and outwardly from an upper end of the inner mesh leg over an upper end of the outer gutter leg; and resilient U-shaped retaining clips each having an inner clip leg extending through the upper leg of the screen to a position therebeneath and below said inturned portion of the outer gutter leg, a clip base extending outwardly of the inner clip leg, and an outer clip leg extending over the inturned portion from the clip base and along a forward surface of the outer gutter leg and said clip base engaging the upper mesh leg and biasing the upper mesh leg against the gutter inturned portion, and wherein the gutter is secured to the facia by spikes driven through the inner gutter leg and the outer gutter leg at preselected longitudinal intervals; and the inner mesh leg is slotted at matching preselected intervals to provide notches having a vertical extent sufficient to allow the inner mesh leg to pass to either side of the spikes and rest at a lower end on the gutter base.

* * * * *